US005516260A

United States Patent [19]

Damlis et al.

[11] Patent Number: 5,516,260

[45] Date of Patent: May 14, 1996

[54] BONDED TURBINE AIRFUIL WITH FLOATING WALL COOLING INSERT

[75] Inventors: Nicholas Damlis, Cincinnati; Anne M. Isburgh, Loveland; James A. Martus, West Chester; Edward H. Goldman, Cincinnati, all of Ohio

[73] Assignee: General Electric Company, Cincinnati, Ohio

[21] Appl. No.: 320,096

[22] Filed: Oct. 7, 1994

[51] Int. Cl.[6] ..... F01D 9/02; F01D 5/18

[52] U.S. Cl. ..... 415/115; 416/96 A

[58] Field of Search ..... 416/96 A, 96 R; 415/115; 29/889.721, 889.722

[56] References Cited

U.S. PATENT DOCUMENTS

| | | | |
|---|---|---|---|
| 2,779,565 | 1/1957 | Bruckmann | 416/96 A |
| 2,847,185 | 8/1958 | Petrie et al. | 416/115 |
| 2,873,944 | 2/1959 | Wiese et al. | 416/96 A |
| 3,540,810 | 11/1970 | Kercher . | |
| 3,616,125 | 10/1971 | Bowling . | |
| 3,707,750 | 1/1973 | Klass | 416/96 A |
| 3,726,604 | 4/1973 | Helms et al. . | |
| 3,806,276 | 4/1974 | Aspinwall . | |
| 3,848,307 | 11/1974 | Kydd . | |
| 3,902,820 | 9/1975 | Amos . | |
| 3,930,748 | 1/1976 | Redman et al. . | |
| 4,056,332 | 11/1977 | Meloni . | |
| 4,063,851 | 12/1977 | Weldon . | |
| 4,064,300 | 12/1977 | Bhangu . | |
| 4,086,021 | 4/1978 | Stenfors . | |
| 4,105,364 | 8/1978 | Dodd . | |
| 4,118,146 | 10/1978 | Dierberger . | |
| 4,183,716 | 1/1980 | Takahara et al. . | |
| 4,252,501 | 2/1981 | Peill . | |
| 4,270,883 | 6/1981 | Corrigan . | |
| 4,312,624 | 1/1982 | Steinbauer, Jr. et al. . | |
| 4,403,917 | 9/1983 | Laffitte et al. . | |
| 4,413,949 | 11/1983 | Scott . | |
| 4,437,810 | 3/1984 | Pearce . | |
| 4,461,612 | 7/1984 | Dodd | 416/96 A |
| 4,482,295 | 11/1984 | North et al. . | |
| 4,501,053 | 2/1985 | Craig et al. . | |
| 4,616,976 | 10/1986 | Lings et al. . | |
| 4,697,985 | 10/1987 | Suzuki . | |
| 4,790,721 | 12/1988 | Morris et al. . | |
| 4,798,515 | 1/1989 | Hsia et al. . | |
| 4,946,346 | 8/1990 | Ito . | |
| 5,176,499 | 1/1993 | Damlis et al. . | |
| 5,259,730 | 11/1993 | Damlis et al. . | |

FOREIGN PATENT DOCUMENTS

| | | | |
|---|---|---|---|
| 47102 | 3/1983 | Japan | 416/96 A |

*Primary Examiner*—Edward K. Look
*Assistant Examiner*—James A. Larson
*Attorney, Agent, or Firm*—Andrew C. Hess; Patrick R. Scanlon

[57] ABSTRACT

A coolable airfoil for use in gas turbine engine component such as a turbine blade or vane is provided with a radially extending airfoil having an outer wall surrounding at least one radially extending cavity and extending chordwise through at least a portion of the airfoil. The outer wall has ribs disposed on an inner surface of the outer wall and cooling passages formed between the outer wall and an insert disposed in the cavity against and in abutting sealing relationship with the ribs, wherein the outer wall is formed from two radially and chordwise extending sections, preferably suction and pressure side sections, bonded together while the insert was disposed inside the cavity. The insert provides an inner wall surrounding a hollow chamber generally conforming to the cavity the insert is disposed in and the insert includes a spring to force the inner wall out against the ribs during the bonding process.

9 Claims, 6 Drawing Sheets

50B
57B
80
BC
82
5
90
68
57C
50C
66
TE
52
55
44
54
B
60R
53B
46
53
49C
49
76
58
59
56
50A
53A
60
57A
LE
64
45
74
72
4C
47C
47
BB
50
78

BONDED TURBINE AIRFUIL WITH FLOATING WALL COOLING INSERT

The Government has rights in this invention pursuant to Contract No. F33615-87-C-2764 awarded by the Department of the Air Force.

BACKGROUND OF THE INVENTION

1. Field of the Invention

This invention relates to cooling of turbine airfoils and, more particularly, to bonded hollow turbine vanes having cooling inserts within outer airfoil walls.

2. Description of Related Art

It is well known to cool parts using heat transfer across walls having hot and cold surfaces by flowing a cooling fluid in contact with the cold surface to remove the heat transferred across from the hot surface. Among the various cooling techniques presently used are convection, impingement and film cooling as well as radiation. These cooling techniques have been used to cool gas turbine engine hot section components such as turbine vanes and blades. A great many high pressure turbine (HPT) vanes, and particularly the high pressure turbine inlet guide vane, also known as the combustor nozzle guide vane, utilize some form of a cooled hollow airfoil. An airfoil typically has a hollow body section which includes a leading edge having a leading edge wall followed by a pressure side wall and a suction side wall which form a substantial part of the outer wall which includes the hot wetted surface on the outside of the walls. The pressure and suction side walls typically converge to form a trailing edge.

Typically, a vane having a hollow airfoil is cooled using two main cavities, one with coolant air fed from an inboard radial location and the other with coolant air fed from an outboard location. These cavities typically contain impingement inserts which serve to receive cooling air and direct the coolant in impingement jet arrays against the outer wall of the airfoil's leading edge and pressure and suction side walls to transfer energy from the walls to the fluid, thereby, cooling the wall. These inserts are positioned by inward protrusions from the outer wall of the airfoil and are referred to as floating because they are not connected to or bonded to the outer wall. These protrusions or positioning dimples are integral with either the insert of the airfoil and provide the barest of contact between the insert and the airfoil wall and therefore are not very effective for forming convective cooling air passages between the insert and the airfoil wall. It is fairly well known in the prior art to use inserts for impingement cooling. However such designs are subject to stacking problems because inserts are inserted into the airfoil cavities after the airfoil has been formed, whether the airfoil is formed as a single piece casting or bonded together from two halves or sections of an airfoil that are cast or formed in some other manner. This limits the degree of twist and curvature variation of the airfoil in the radial direction.

Other prior art designs included double wall outer shell airfoils where the outer shell of the airfoil had an inner and outer wall integrally formed or bonded together to form cooling passages therebetween. Such designs are subject to large temperature differentials $\Delta T$ across the airfoils shells thereby causing thermal stresses that could break the bond or separate the inner and outer walls. This, in turn, would reduce the structural integrity and effectiveness of the cooling passages and could lead to airfoil failure.

Another drawback of turbine airfoils using inserts disclosed in the prior is that the insert must be installed into the vane or airfoil cavity by inserting it through either a radially inner or outer diameter cavity opening. This imposes restrictions on the aerodynamics and airfoil stacking by requiring that the vane cavities be relatively straight (line of sight) with little if any twist or centerline curvature permissible. In addition to providing clearance to allow the insert to be inserted, additional clearance may be required to account for manufacturing tolerances on both the insert and cavity contour which further restrict the shapes of cooled airfoil designs.

Turbine vane cooling requires a great deal of cooling fluid flow which typically requires the use of power and is therefore generally looked upon as a fuel efficiency and power penalty in the gas turbine industry. Any improvement to the overall efficiency and effectiveness of turbine vane cooling would provide a great cost saving and fuel efficiency benefit to gas turbine designs. Therefore, there is a great need for a cooled airfoil design particularly for use in turbine vanes which have twist and/or a curved radially extending stacking line or centerline.

The present invention provides improved turbine airfoil cooling and engine efficiency and is particularly useful for cooled turbine vanes having airfoils which have twist and/or a curved radially extending stacking line or centerline.

SUMMARY OF THE INVENTION

According to the present invention, a radially extending airfoil having an outer wall surrounding at least one radially extending cavity and extending chordwise through at least a portion of the airfoil. The outer wall has ribs disposed on an inner surface of the outer wall and cooling passages formed between the outer wall and an insert disposed in the cavity against and in abutting sealing relationship with the ribs, wherein the outer wall is formed from two radially and chordwise extending sections, preferably suction and pressure side sections, bonded together while the insert was disposed inside the cavity. The insert provides an inner wall surrounding a hollow chamber generally conforming to the cavity the insert is disposed in and a spring means to force the inner wall out against the ribs during the bonding process as well as during the cooling process when the engine is operating. One particular embodiment provides that adjacent ones of the ribs form cooling passages between the outer wall and the insert. The insert is made of sheet metal and may have a twisted radially extending cross-sectional distribution so that both the airfoil and conforming insert may have twist.

Various embodiments of the present invention include an insert having an inner wall that extends around the entire cavity such as may be used in a central cavity. Another embodiment has an inner wall that extends around the only the ribbed portion of the cavity such as may be used in a leading edge cavity. Yet another embodiment has an inner wall that extends around the entire cavity and has a slot at its aft nose edge such as may be used in a trailing edge cavity.

The cooling passages may be fully convective or employ impingement cooling and associated impingement cooling holes through the insert inner wall. The invention includes embodiments wherein the cooling passages may be radially or axially extending and wherein the cooling passages may be single pass straight through or multiple pass serpentine shaped. A means is provided for directing cooling air through the platform of the blade or vane into the cooling passages from a compressor of the engine or into the hollow chamber of the insert.

One embodiment of the present invention provides shower head holes through the airfoil at the leading edge of the airfoil for leading edge cooling as is well known in the art and by which its construction is greatly simplified and reduced in cost by the present invention. Film cooling means may also be provided for the outer wall by the use of holes or slots as is well known in the art. Another feature well known in the art and which may be employed with the present invention is the use of trailing edge cooling means such as cooling slots.

ADVANTAGES

The present invention provides a gas turbine engine coolable airfoil having a split and bonded outer wall with a floating insert that was disposed inside the airfoil when it pieces were bonded together for forming improved performance cooling passages with ribs on an inner side of the airfoil outer wall. The construction of the ribs and insert of the present invention provide better sealing of the cooling passages and therefore improved cooling of the airfoil than schemes using inserts of the prior art. The outer wall is operable to be cooled convectively and/or by impingement flows and is able to be more effectively cooled as compared to cooling schemes in the prior art. The present invention also provides a means for using inserts with airfoils that have exotic or highly contoured shapes and twist and improved aerodynamic properties and capabilities. This results in a significant reduction in coolant requirements and thus improved turbine efficiency. The invention also reduces the amount of coolant flow required which improves engine fuel efficiency.

The cooling effectiveness of the airfoil of the present invention is improved by virtue of the reduced manufacturing tolerances on the internal cavity features such as the width and depth of the individual cooling passages. This will allow the amount of cooling air required for a given metal temperature to be reduced, resulting in an improvement in engine cycle efficiency. In addition cooling features that are presently not producible by conventional means would now be feasible by virtue of the fact that the airfoil internals are now accessible. This is not the case with the prior art. Increased manufacturing tolerances acting on the cavity features and insert and increased clearance for insertion of the insert of the prior art all combine to reduce the cooling effectiveness of the designs in the prior art.

The foregoing, and other features and advantages of the present invention, will become more apparent in the light of the following description and accompanying drawings.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
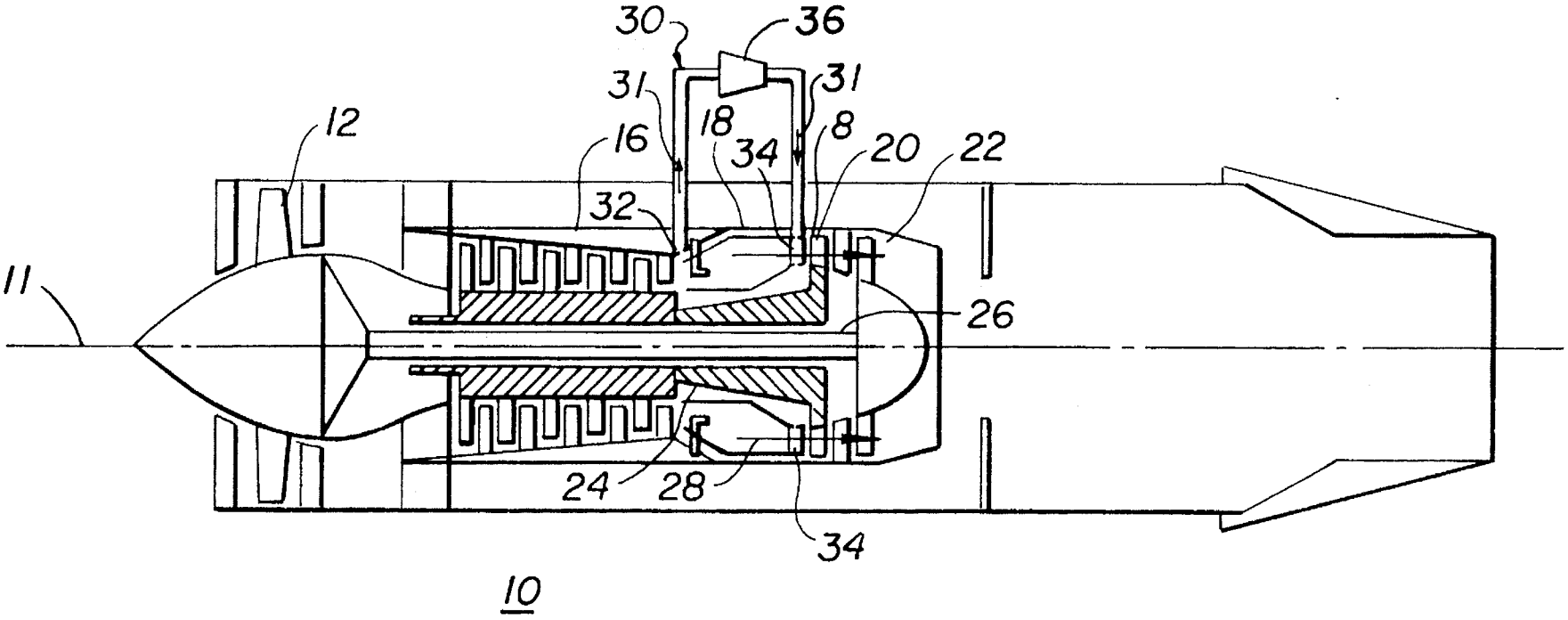
FIG. 1 illustrates a cross-sectional view of a gas turbine engine having turbine inlet guide vanes with coolable airfoils having floating cooling inserts in accordance with the present invention.

Illustrated in FIG. 1 is an airfoil cooling means constructed in accordance with the present invention as generally indicated at 8 in a gas turbine engine 10. The gas turbine engine 10 is circumferentially disposed about an engine centerline 11 and has, in serial flow relationship, a fan section indicated by a fan section 12, a high pressure compressor 16, a combustion section 18, a high pressure turbine 20, and a low pressure turbine 22. The combustion section 18, high pressure turbine 20, and low pressure turbine 22 are often referred to as the hot section of the engine 10. A high pressure rotor shaft 24 connects, in driving relationship, the high pressure turbine 20 to the high pressure compressor 16 and a low pressure rotor shaft 26 drivingly connects the low pressure turbine 22 to the fan section 12. Fuel is burned in the combustion section 18 producing a very hot gas flow 28 which is directed through the high pressure and low pressure turbines 20 and 22 respectively to power the engine 10. A cooling air supply means 30 provides cooling air 31 from a compressor stage of the engine 10 such as a bleed means at compressor discharge 32 to a downstream element of the hot section such as the turbine inlet guide vane 34. The pressure of the cooling air taken from the compressor discharge 32 may be boosted by an optional supplemental compressor 36 if desired. The turbine inlet guide vane 34 includes a leading edge LE and a trailing edge TE as shown in FIG. 2.

Figure 2:
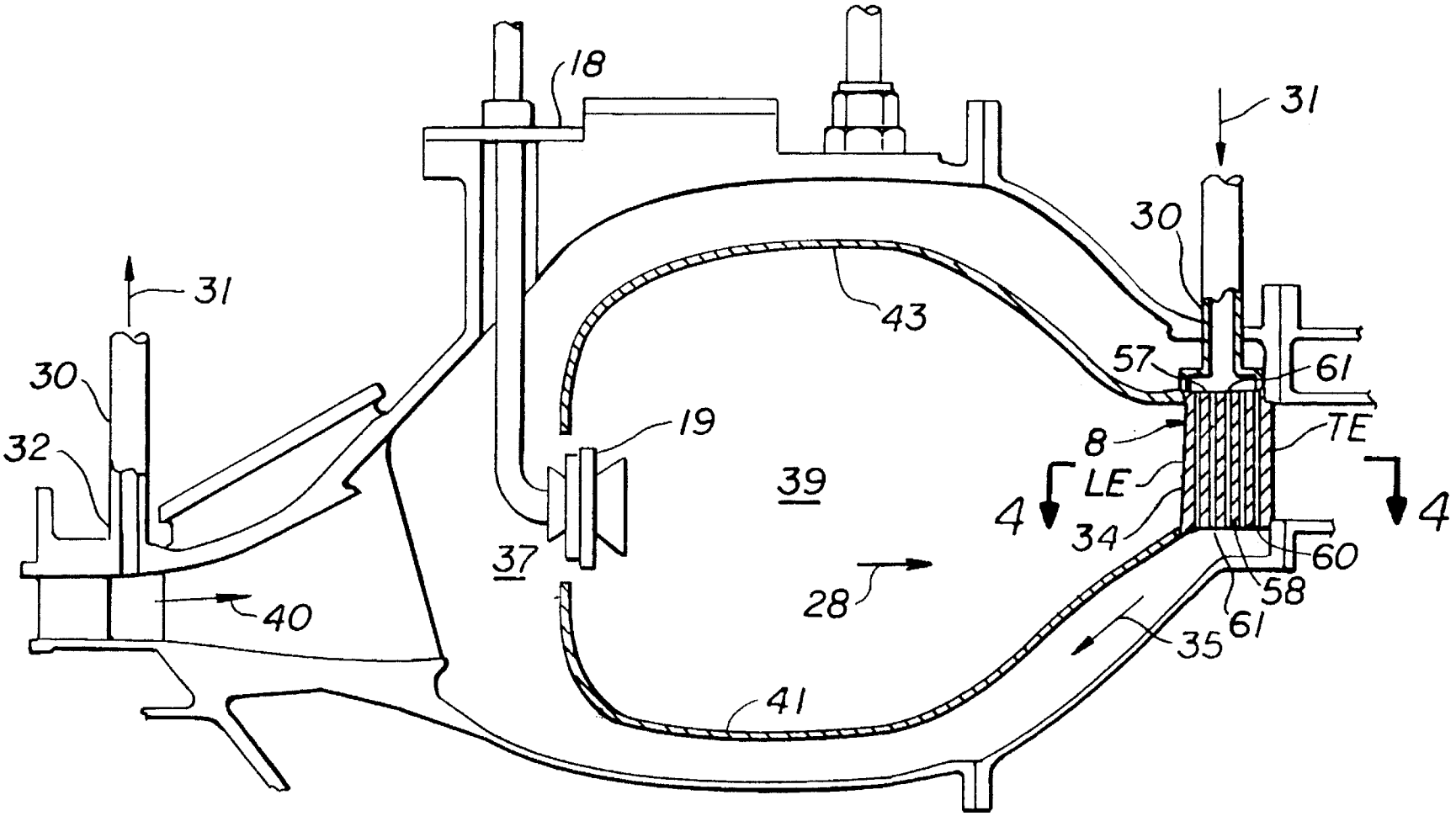
FIG. 2 illustrates an enlarged cross-sectional view of a portion of a hot section with a regenerative combustor in the engine illustrated in FIG. 1.

Illustrated in FIG. 2 is an example of a portion of a hot section of the engine 10 which is constructed to regeneratively use the cooling air 31 which is supplied to the vane 34 after it is discharged from the airfoil cooling means 8 that is disposed in vane 34 to recapture energy in the form of heat in cooling air outflow 35. The cooling air outflow 35 is directed into the inlet 37 of a combustion chamber 39 between inner and outer combustor liners, 41 and 43 respectively, in the combustion section 18 where it is mixed with fuel from fuel injectors 19 and compressor discharge airflow 40 for combustion. Thus heat energy transferred from the hot gas flow 28 through the vane 34 is recaptured in the form of heat in the outflow 35 and directed back into the combustion chamber 39 to be used for doing work in the turbine section. The airfoil cooling means 8 is illustrated as including a plurality of cooling passages 60 having openings 61 which serve as inlets or outlets, depending on the direction of the cooling airflow 31 through the cooling passages. The plurality of cooling passages 60 are formed between radially extending ribs 58 and an insert 57 that is constructed in accordance with the present invention as discussed in more detail further herein.

Figure 2A:
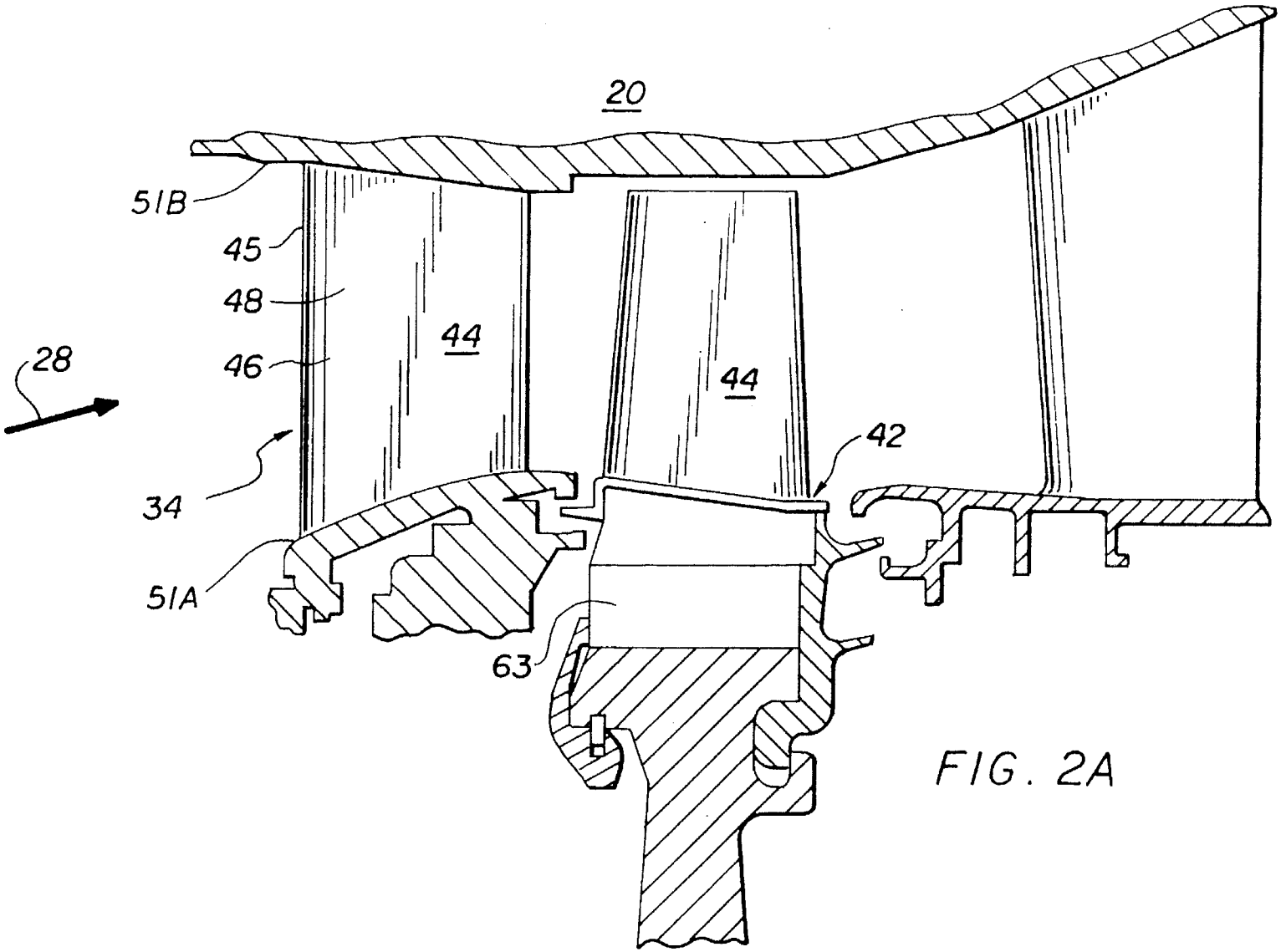
FIG. 2A illustrates an elevated view of a portion of a hot section with coolable airfoils in a turbine of the engine illustrated in FIG. 1.

FIG. 2A more particularly illustrates the inlet guide vane 34 having an airfoil 44 constructed in accordance with the present invention. The airfoil 44 construction of the present invention may be used for any cooled airfoil such as in a turbine blade 42. The airfoil 44 has an outer wall 46 with a hot wetted surface 48 which is exposed to the hot gas flow 28. Vanes 34, and in many cases turbine blades 42, are often cooled by air routed from the fan or one or more stages of the compressors. Air is typically directed through an inner platform 51A or an outer platform 51B of the vane 34. In the case of a blade, by a conventional cooling air injection system, air is typically directed radially outward through a root 63 of the blade 42. The present invention provides an internal cooling scheme for airfoils 44.

Figure 3:
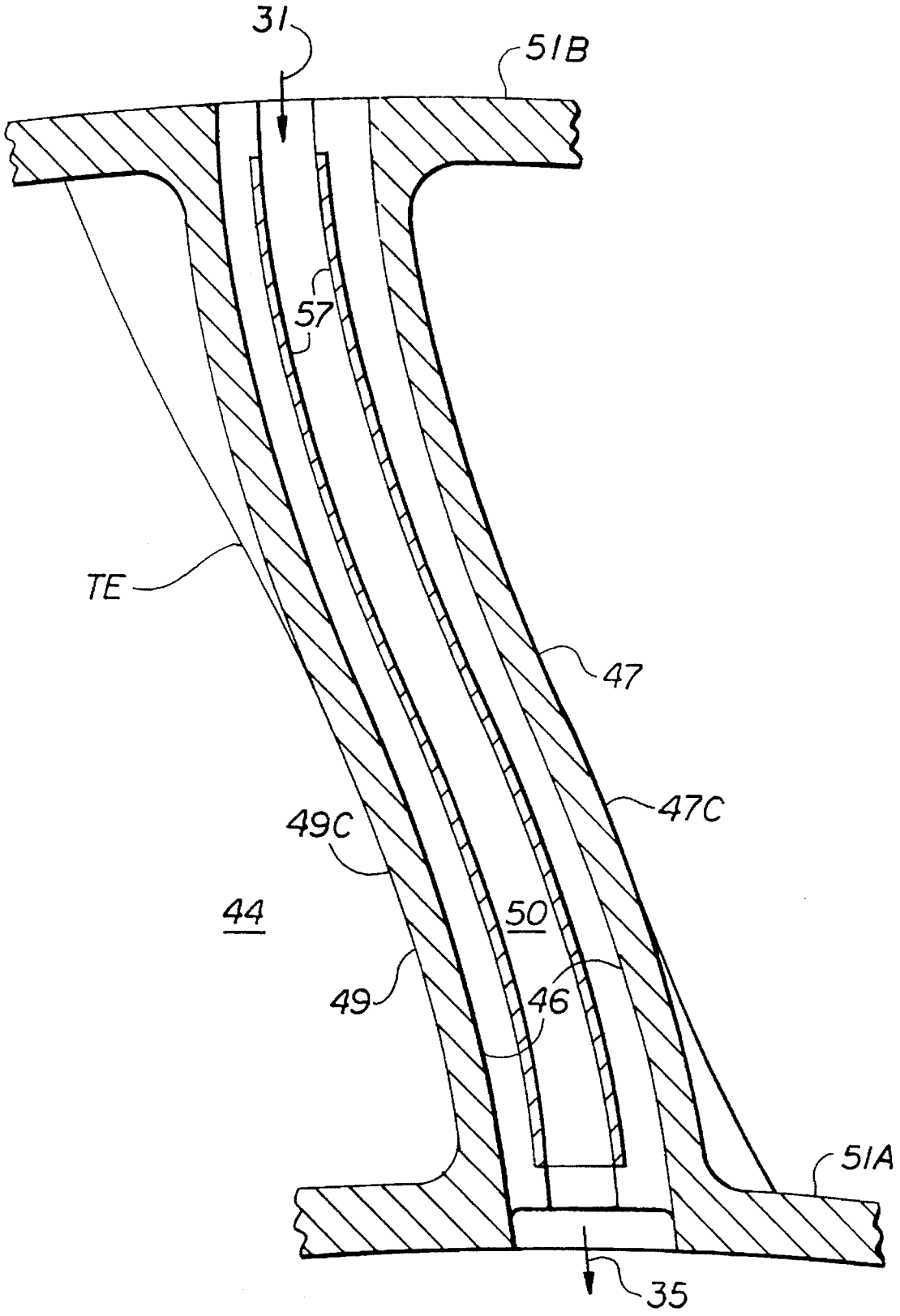
FIG. 3 illustrates an axially aft facing elevational view through a cross-section of a cooled turbine vane airfoil and insert having circumferential contour and twist in accordance with one embodiment of the present invention.

Illustrated in FIG. 3 is the airfoil 44 having an outer wall 46 which surrounds at least one generally radially extending cavity 50. The airfoil 44 has a highly curved suction side 47 and a highly curved pressure side 49 and terminates in the trailing edge TE which is illustrated as indicating the airfoil has a high degree of twist. The airfoil 44 is operably constructed to receive cooling air 31 through an outer platform 51B and discharge it though an inner platform 51A of the airfoil. The insert 57 generally conforms in shape to the outer wall 46 and, as is obvious from FIG. 3, the floating insert cannot be inserted after the outer wall has been constructed as is conventionally done. Construction of the airfoil usually includes bonding of cast sections of an airfoil generally corresponding to the suction side 47 and the pressure side 49 in FIGS. 2 and 3. The airfoil 44 is preferably constructed from two sections, a suction side section 47C generally coinciding with the suction side 47 and a pressure side section 49C generally coinciding with the pressure side 49. The suction side and pressure side sections, 47C and 49C respectively, are bonded together while the insert was disposed inside the cavity 50.

Figures 4, 4A, 4B, 4C:
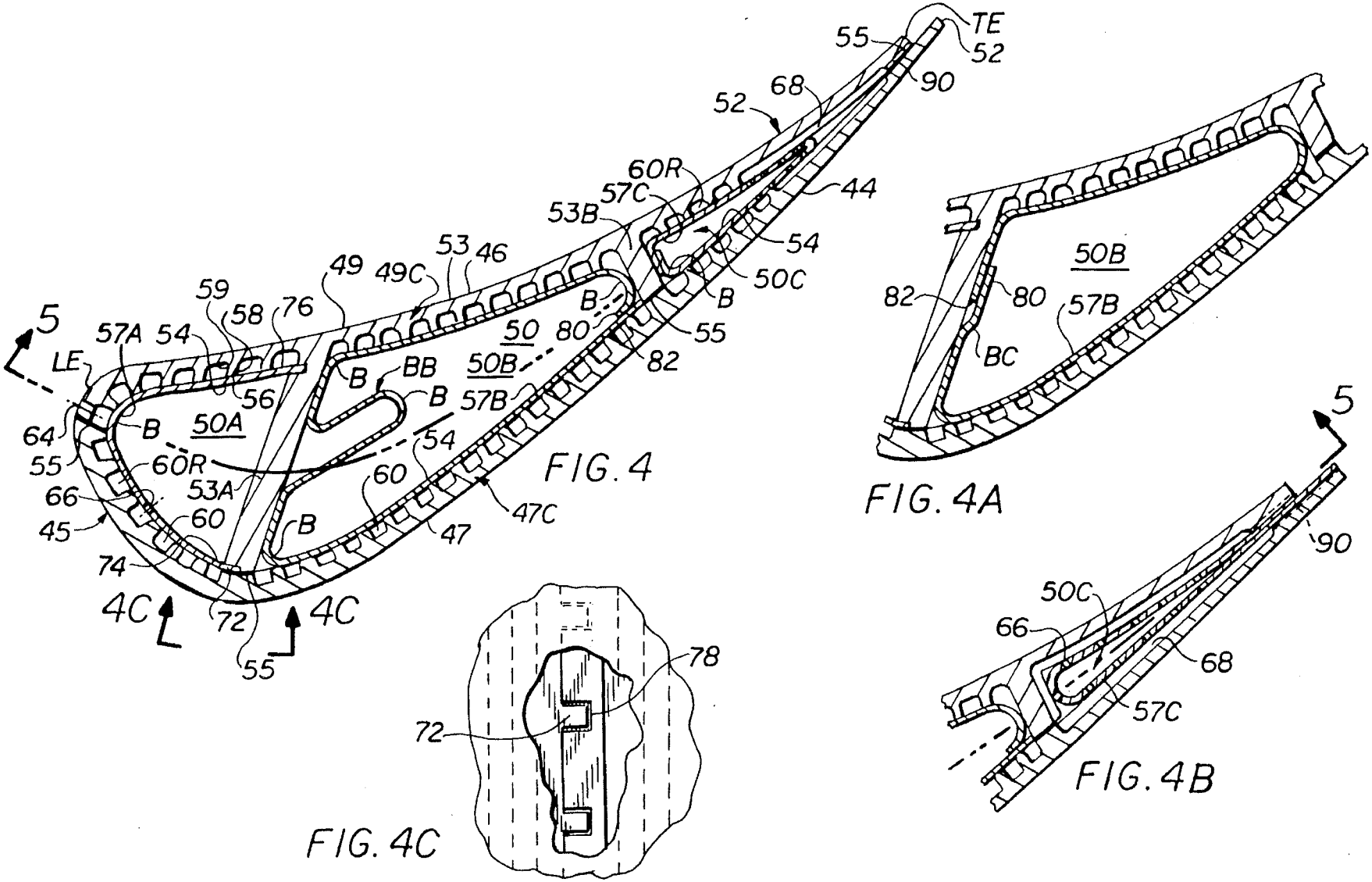
FIG. 4 illustrates a cross-sectional view of a cooled turbine vane airfoil taken through 4—4 in FIG. 2 in accordance with a first exemplary embodiment of the present invention.
FIG. 4A illustrates a portion of a cross-sectional view of a convectively cooled turbine vane airfoil taken through 4—4 in FIG. 2 in accordance with a second exemplary embodiment of the present invention.
FIG. 4B illustrates a portion of a cross-sectional view of a convectively cooled turbine vane airfoil taken through 4—4 in FIG. 2 in accordance with a third exemplary embodiment of the present invention.
FIG. 4C illustrates a positioning means for insert illustrated in FIG. 4.

Illustrated in FIG. 4 is an exemplary embodiment of the airfoil 44 which includes a leading edge portion 45, a middle portion 53, and a trailing edge portion 52. The suction side section 47C and the pressure side section 49C are bonded along a bonding interface or surface generally indicated by a bond line 55 and provide the outer wall 46 of the airfoil 44. A forward wall 53A and an aft wall 53B extend between the suction side 47 and the pressure side 49 of the outer wall 46 dividing the cavity 50 into three radial and chordwise extending cavities; a forward cavity 50A, a middle cavity 50B, and an aft cavity 50C. The bond line 55 extends across the outer wall 46 at about the leading edge LE, then across the surface interface between the outer wall and the forward wall 53A and the aft wall 53B, and between abutting portions of the suction side section 47C and the pressure side section 49C of the outer wall along the trailing edge TE. Received within each of these chordwise extending cavities is a corresponding insert 57; a forward insert 57A, a middle insert 57B, and an aft insert 57C in accordance with the present invention wherein the outer wall 46 was formed by bonding together the suction side section 47C to the pressure side section 49C while each of the inserts were disposed inside its corresponding cavity.

The forward, middle, and aft inserts 57A–57C, respectively, are preferably made from a material with a melting point higher than the bonding temperature used to bond the airfoil sections together. The insert is preferably fabricated from sheet stock and, more specifically, rolled nickel or stainless steel alloys. This provides an inner wall 54 that presses up tight against a plurality of ribs 58 inwardly extending from the outer wall 46 and which form cooling passages 60 between the ribs 58 and co-extending portions 59 of the inner wall 54. The inserts are bent and shaped to generally conform to the curved and twisted shape of the airfoil 44 and its outer wall 46. The inserts have multiple embodiments that include single bends such as u-bends B and multiple bends B such as used in hairspring BB and joggle BC (shown in FIG. 4A) which provide a spring means for forcing the inner wall 54 against inwardly facing relatively flat surfaces 56 of ribs 58. These bends provide the inserts with a shape that is larger than the cavity into which they are received so as to place the inserts in compression causing the inner wall 54 to tightly press against the radially extending ribs on the outer wall 46. This provides good sealing of the cooling passages 60 between the ribs 58 and the inner and outer walls, 54 and 46 respectively, under varying thermal and load conditions which tend to force the inner wall 54 and the outer wall 46 apart.

The forward insert 57A is disposed in forward cavity 50A forming radial cooling passages 60R which may be completely convectively cooled. The cooling of convectively cooled radial cooling passages 60R may be supplemented by impingement cooling using impingement cooling holes 66 through the inner wall 54 of insert 57. Showerhead cooling holes 64 disposed through outer wall 46 leading from one or more of radial cooling passages 60R may be used to cool the leading edge LE and downstream positions of the airfoil 44. Optionally, the forward insert 57A includes a number of chordwise extending tabs 72 radially disposed along a suction side extending first end 74 and optionally along a pressure side extending second end 76 as is more specifically illustrated in FIG. 4C. The tabs 72 are indexed in corresponding recesses 78 in the wall structure of the airfoil 44 which includes the outer wall 46 and the forward wall 53A. The tabs 72 help keep the insert in place during the bonding process.

Referring again to FIG. 4, middle insert 57B and aft insert 57C are bent to provide a spring means and have overlapping inner and outer edges 80 and 82 respectively to provide a sealing means for their respective cavities interior to these inserts, i.e. middle cavity 50B for middle insert 57B and aft cavity 50C for aft insert 57C. The middle insert 57B is disposed in the middle cavity 50B forming radial cooling passages 60R which may be completely convectively cooled or may be supplemented by impingement cooling using impingement cooling holes 66 through the inner wall 54 of insert 57. The middle insert 57B forms a continuous seal with the radially extending ribs 58 about the periphery of the middle cavity 50B.

The cooling scheme for the trailing edge portion of the airfoil 44 for the embodiment illustrated in FIG. 4 provides radially extending cooling passages 60R and chordwise extending cooling passages 68. The cooling air for the radially extending cooling passages 60R may be supplied with air through inlets in the inner or outer platforms, 51A and 51B respectively. Cooling air supplied to the aft cavity 50C can be used to supply supplemental impingement cooling air through impingement cooling holes 66 through the aft insert 57C and impingement cooling air to the chordwise extending cooling passages 68 which are formed between the aft insert 57C and chordwise extending ribs (not shown in FIG. 4 but shown as 69 in FIG. 5). The cooling air in the chordwise extending cooling passages 68 is flowed chordwise in the aft direction through a cooling air exit slots 90 as in commonly known in the art. FIG. 4A incorporates what is known as a joggle indicated at the bend BC on the inner edge 80 which overlaps the outer edge 82 so as to provide both bending and spring means for the middle insert 57B. This alternative may prove useful in some applications.

Illustrated in FIG. 4B is an alternative cooling scheme for the trailing edge portion of the airfoil. The chordwise extending cooling passages 68 are supplied and cooled with impingement cooling air from the aft cavity 50C through impingement holes 66 in the aft insert 57C. The impinging cooling air is then flowed chordwise in the aft direction through chordwise extending cooling passages 68. The chordwise extending cooling passages 68 are preferably supplied by the impingement cooling holes 66 in the aft insert 57C. The cooling air then passes through the exit slots 90 as in commonly known in the art. As can be readily seen in FIGS. 4, 4*a* and 4*b*, each of these continuous inserts, i.e. continuous in the chordwise direction and around the periphery of their respective cavities, are capable of holding pressure and maintaining a pressure differential between the insert and the cooling passages including the radial cooling passages 60R. This pressure differential capability allows for proper air distribution through impingement holes 66 or alternatively through convective passages. This pressure differential capability also forces the insert inner wall 54 to tightly press against the radially extending ribs 58 on the outer wall 46 or the chordwise extending ribs 69. The ends because of the spring means provided by the bends are kept in sealing engagement and are shaped so that the inner end conforms to the overlapping outer end both in a radial and chordwise direction, thus allowing for slight movement or shifting due to thermal growth and the pressure differential.

Figure 5:
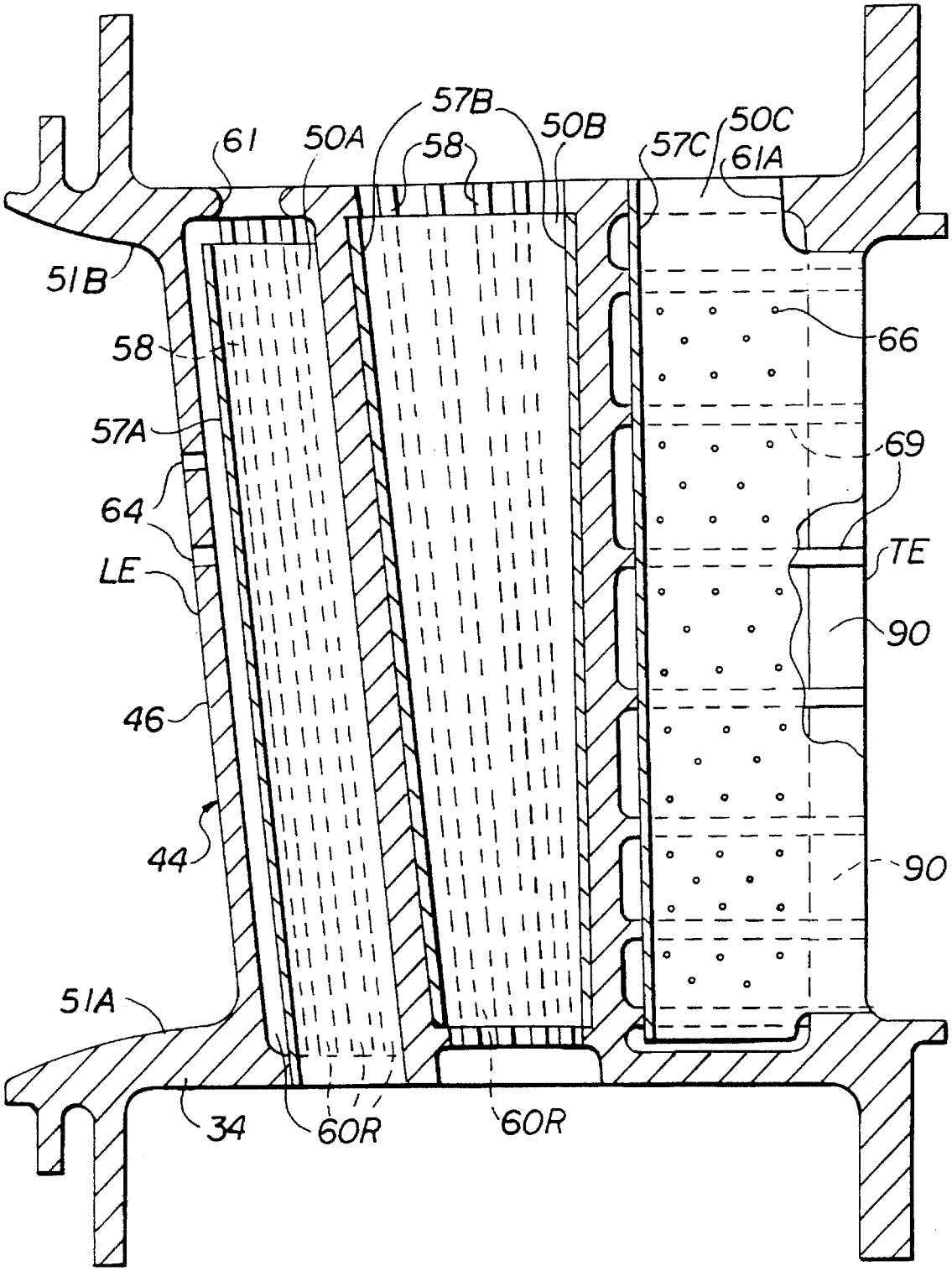
FIG. 5 illustrates in cross-sectional view, an alternative embodiment of the first turbine inlet guide vane taken through a centerline 5—5 which starts at the leading edge LE in FIG. 4 and at the aft wall 53B continues through in FIG. 4B to the trailing edge TE.

Illustrated in FIG. 5, is the inlet guide vane 34 and its airfoil 44 laid out in a planform cross-sectional view to more specifically illustrate the cooling schemes of the present invention. In the forward cavity 50A radially extending convective cooling passages 60R are supplied with air through one of the opening 61 in the radially outer platform 51B. The opening serves as a cooling air inlet allowing cooling air designated by the arrows to flow to the forward cavity 50A and into the radial extending cooling passages 60R between the radially extending ribs 58. The showerhead cooling holes 64 disposed through outer wall 46 flows cooling air from one of radial cooling passages 60R. The cooling air for these passages of the forward cavity 50A and its respective forward insert 57A flows straight through the radial passages and discharges though openings in the inner platform 51A.

Cooling air is flowed into the middle cavity 50B within the middle insert 57B and through the adjoining radially extending cooling passages 60R between the middle insert 57B, the outer wall 46, and the ribs 58 wherein the ribs extend radially outward through the outer platform 51B. All the cooling air from flows are then discharged through the outer platform 51B. Although not shown, optionally, the cooling flow in the radial cooling passages 60R may be supplemented by impingement cooling holes as shown in FIG. 4. Still referring to FIG. 5, the aft cavity 50C is supplied with cooling through an aft opening 61A through the outer platform 51B and all this cooling air is flowed through the aft cavity 50C and through impingement cooling holes 66 in the aft insert 57C into a plurality of chordwise extending impingement cooling passages 68. The chordwise extending impingement cooling passages 68 are formed between the aft insert 57C and chordwise extending ribs 69 in the aft direction and exhaust into the cooling exit slots 90.

The vane 34 and the airfoil 44 is constructed by bonding the suction side section 47C to the pressure side section 49C while the inserts 57A–57C are disposed inside their respective cavities. The two sections are preferably cast with all of the internal features as possible. These features include the ribs and the forward wall 53A and the aft wall 53B and any other internal walls dimples, grooves, etc that may be desired. These features may also be machined after the two sections are already cast. Bonding foil is then placed along the bonding interfaces or surfaces of the two airfoil/vane sections. The inserts would then be fitted between the airfoil halves along with the diffusion bonding foil, or other bonding surface treatment which is placed only on the bonding surfaces along the bond plane indicated by the bond line 55 in the drawings, and then all the pieces would be subjected to the diffusion bonding process. The physical joining of the two airfoil sections occurs only along the bond plane. The inserts due to the bonding temperatures and the load imposed on the vane halves to bring and hold them together during bonding, would be hot sized and conform to fit their respective internal airfoil cavities. This hot sizing of the insert will also serve to negate any adverse manufacturing tolerances present on the insert or cavity contour. The high bonding temperature of approximately 2300° F. will effectively stress relieve the stress in the insert leaving it stress free after bonding. The insert material can be any of the high temperature sheet stocks presently available that have a melting point higher then the bonding cycle temperatures.

While the preferred and an alternate embodiment of the present invention has been described fully in order to explain its principles, it is understood that various modifications or alterations may be made to the preferred embodiment without departing from the scope of the invention as set forth in the appended claims.

We claim:

1. A coolable airfoil for use and exposure in a hot gas flow of a gas turbine engine, said coolable airfoil comprising:

at least a first and a second radially and chordwise extending sections with at least one radially extending cavity therebetween, an outer wall extending around at least a portion of said sections, said outer wall having ribs disposed on an inner surface of said outer wall, cooling passages formed between said outer wall and a floating insert disposed in said cavity against and in abutting sealing relationship with said ribs, wherein said sections are bonded together while said insert is disposed inside said cavity, and said insert includes an inner floating wall that is unbonded to said ribs and includes a spring means to force said inner wall against said ribs.

2. A coolable airfoil as claimed in claim 1 wherein said cooling passages are convective cooling passages formed between adjacent ones of said ribs and said insert.

3. A coolable airfoil as claimed in claim 1 wherein said insert includes impingement cooling holes to said passages formed between adjacent ones of said ribs.

4. A coolable airfoil as claimed in claim 1 wherein said insert is made of sheet metal and has twist to provide a twisted radially extending cross-section distribution.

5. A coolable airfoil as claimed in claim 1 wherein said insert is made of sheet metal and has a curved radially extending centerline.

6. A vane comprising;

an inner platform, an outer platform radially spaced apart from said inner platform, a coolable airfoil radially extending between said platforms wherein said airfoil comprises:

at least a first and a second radially and chordwise extending sections with at least one radially extending cavity therebetween, an outer wall extending around at least a portion of said sections, said outer wall having ribs disposed on an inner surface of said outer wall, and cooling passages formed between said outer wall and a floating insert disposed in said cavity against and in abutting sealing relationship with said ribs, wherein said sections are bonded together while said insert is disposed inside said cavity, and said insert includes an inner floating wall that is unbonded to said ribs and includes a spring means to force said inner wall against said ribs.

7. A vane as claimed in claim 6 further comprising at least one inlet to at least one of said passages wherein said inlet comprises a first opening through a first one of said platforms.

8. A vane as claimed in claim 7 further comprising at least one outlet to at least one of said passages wherein said outlet comprises a second opening through a second one of said platforms.

9. A vane as claimed in claim 6 wherein said cooling passages are single pass straight through passages and further comprise a first plurality of openings through a first one of said platforms at radially inner ends of each of said passages and a second plurality of openings through a second one of said platforms at radially outer ends of each of said passages wherein inlets to said passages comprise one of said first and second pluralities of openings and outlets to said passages comprise another of said first and second pluralities of openings.

* * * * *